US005411089A

United States Patent [19]

Vinegar et al.

[11] Patent Number: 5,411,089

[45] Date of Patent: May 2, 1995

[54] HEAT INJECTION PROCESS

[75] Inventors: Harold J. Vinegar; Eric P. De Rouffignac, both of Houston; Lawrence J. Bielamowicz; Phillip T. Baxley, both of Bellaire; Scott L. Wellington, Houston, all of Tex.

[73] Assignee: Shell Oil Company, Houston, Tex.

[21] Appl. No.: 170,564

[22] Filed: Dec. 20, 1993

[51] Int. Cl.[6] ..... E21B 43/24; E21B 36/02; E21B 36/04

[52] U.S. Cl. ..... 166/272; 166/245

[58] Field of Search ..... 166/302, 303, 60, 59, 166/272, 245

[56] References Cited

U.S. PATENT DOCUMENTS

| | | | |
|---|---|---|---|
| 2,902,270 | 9/1959 | Salomonsson et al. | 166/302 |
| 2,914,309 | 11/1959 | Salomonsson | 166/245 |
| 3,181,613 | 5/1965 | Krueger | 166/300 |
| 4,640,352 | 2/1987 | Vanmeurs et al. | 166/245 |
| 4,886,118 | 12/1989 | Van Meurs et al. | 166/245 |
| 5,060,287 | 10/1991 | Van Egmond | 392/301 |
| 5,065,818 | 11/1991 | Van Egmond | 166/60 |
| 5,255,742 | 10/1993 | Mikus | 166/303 |
| 5,297,626 | 3/1994 | Vinegar et al. | 166/271 |

FOREIGN PATENT DOCUMENTS 123137 11/1948 Sweden .

*Primary Examiner*—Stephen J. Novosad
*Attorney, Agent, or Firm*—Del S. Christensen

[57] ABSTRACT

A method for heat injection into a subterranean diatomite formation is provided. A heater is placed in a wellbore within the diatomite formation, and the heater is then operated at a temperature above that which the heater could be operated at long term in order to better sinter the formation in the vicinity of the wellbore. The improved sintering of the diatomite significantly improves the heat transfer coefficient of the diatomite and thereby increases the rate at which heat can be injected from a constant limited long term heater temperature.

13 Claims, 5 Drawing Sheets

HEAT INJECTION PROCESS

FIELD OF THE INVENTION

This invention relates to a method for injection of heat into a subterranean diatomite formation.

BACKGROUND OF THE INVENTION

U.S. Pat. Nos. 4,640,352 and 4,886,118 disclose conductive heating of subterranean formations of low permeability that contain oil to recover oil therefrom. Such low permeability formations include oil-bearing diatomite formations. Diatomite is a soft rock that has very high porosity but low permeability. Conductive heating methods to recover oil are particularly applicable to diatomite formations because these formations are not amenable to secondary oil recovery methods such as water, steam, or carbon dioxide flooding. Flooding fluids tend to penetrate formations that have low permeabilities preferentially through fractures. The injected fluids therefore bypass a large amount of the hydrocarbons in the diatomite formations. In contrast, conductive heating does not require fluid transport into the formation. Oil within the formation is therefore not bypassed as in a flooding process.

Vertical temperature profiles will tend to be relatively uniform when the temperature of a formation is increased by conductive heating. This is because formations generally have relatively uniform thermal conductivities and specific heats. Transportation of hydrocarbons in a thermal conduction process is by pressure drive, vaporization, and thermal expansion of oil and water trapped within the pores of the formation rock. Hydrocarbons migrate through small fractures created by the expansion and vaporization of the oil and water.

Considerable effort has been expended to develop electrical resistance heaters suitable for injecting heat into formations having low permeability for thermal conductive heating of such formations. U.S. Pat. Nos. 5,065,818 and 5,060,287 are exemplary of such effort. U.S. Pat. No. 5,065,818 discloses a heater design that is cemented directly into a formation to be heated, eliminating the cost of a casing in the formation. However, a relatively expensive cement such as a high-alumina refractory cement is needed.

Gas-fueled well heaters which are intended to be useful for injection of heat into subterranean formations are disclosed in, for example, U.S. Pat. Nos. 2,902,270, and 3,181,613 and Swedish Patent No. 123,137. The heaters of these patents require conventional placement of casings in the formations to house the heaters. Because the casings and cements required to withstand elevated temperatures are expensive, the initial cost of such heaters is high.

U.S. Pat. No. 5,255,742 (application Ser. No. 896,861 filed Jun. 12, 1992) and application Ser. No. 896,864 filed Jun. 12, 1992, now U.S. Pat. No. 5,297,626, respectively, disclose fuel gas-fired subterranean heaters. The heaters of this patent and patent application utilize flameless combustion to eliminate hot spots and reduce the cost of the heater, but still use high alumina refractory cements to set the burner within the formation.

It is therefore an object of the present invention to provide a method to inject heat into a subterranean diatomite formation utilizing a heater within a wellbore wherein the thermal conductivity of the formation in the vicinity of the wellbore is enhanced over the thermal conductivity that could be obtained by sintering the formation only at the long-term heater operating temperatures.

SUMMARY OF THE INVENTION

This and other objects are accomplished by a method for heating a subterranean diatomite formation, the method comprising the steps of:

(a) drilling a wellbore into the diatomite formation;

(b) inserting a heater into the wellbore;

(c) initially operating at a long term operating temperature for a time period of greater than about six months, which long term operating temperature is at or below a temperature at which the heater would be expected to operate for a period of about ten years or longer;

(d) raising the heater temperature to a temperature that is at least 100° F. greater than the long term operating temperature for between about one day and about thirty days; and (e) operating the heater for an extended period of time at or below the long term operating temperature.

Diatomite around the heater will sinter upon exposure to elevated temperatures and earth stresses, become relatively strong and creep resistant, and have significantly improved thermal conductivity compared to the original diatomite formation and compared to the formation exposed to a history of lower temperatures. Elevating the temperature of the heater for even a relatively short period improves the heat transfer properties of the near-wellbore formation and increases the amount of heat that can be injected into the formation at a limited long term heater temperature. The limited time period during which the temperatures of the heater are elevated in the practice of the present invention will not significantly increase the initial cost of the heater.

The heater can be, for example, an electrical heater or a gas-fired heater. A gas-fired heater is preferred because of reduced operating costs. A gas-fired heater utilizing continuous flameless combustion is particularly preferred because of the savings in the cost of materials.

The heater of the present invention is preferably placed in the formation without cement. Diatomite is sufficiently plastic that lateral formation stresses cause the diatomite to close tightly around the heater within about two days. Elimination of the cement eliminates problems resulting from inconsistent cement coverage around the heater. The cost of providing the heat injection well is also significantly reduced by elimination of the cement because of the relatively high cost of acceptable cement.

DETAILED DESCRIPTION OF THE INVENTION

According to the present invention, a heater is placed in a diatomite formation and then the heater is fired to sinter the diatomite in the vicinity of the heater. The sintering is performed by first heating the formation in the near-wellbore region to an elevated temperature, and then, for a relatively short time period, elevating the heater temperature beyond a temperature at which the heater could be operated for an extended time period. The heater is then operated at a temperature at which it could be operated for an extended time period. Sintering at a temporarily elevated temperature significantly improves the sintering and thermal conductivity of the diatomite in the vicinity of the heater. By sintering, it is meant that the diatomite grains are fused together at the points of contact. The porosity can be reduced from an initial porosity of about sixty percent to a porosity of less than about twenty percent by the application of heat and/or pressure to the diatomite.

Heating diatomite to temperatures of about 1800° F. (982° C.) also causes the diatomite to undergo changes in crystal structure. Initially, the composition of a typical diatomite, as determined by X-ray diffraction, is about 50% by weight Opal-A (amorphous with a grain density of about 2.2 g/cm) and about 20 to 25% by weight Opal-CT (crystalline with a grain density of about 2.6 g/cm). The remaining components are divided among sodium-Feldspar, illite, quartz, pyrite, cristobalite and hematite. After the diatomite is heated to about 1832° F. (1000° C.), the composition is almost 90% by weight Opal-CT. After exposure to elevated temperatures, heat can be transferred from a wellbore more readily because opal-CT has a significantly greater thermal conductivity than Opal-A.

Sintering of the diatomite can drastically decrease the porosity of the diatomite. The porosity of the diatomite is initially about 62%. Upon heating, this porosity rapidly decreases starting at about 1470° F. (800° C.). The porosity of diatomite that has been heated to about 2200° F. (1204° C.) without stress is about 28%, and with normal formation lateral stress imposed, this porosity decreases to less than twenty percent.

Figure 1:
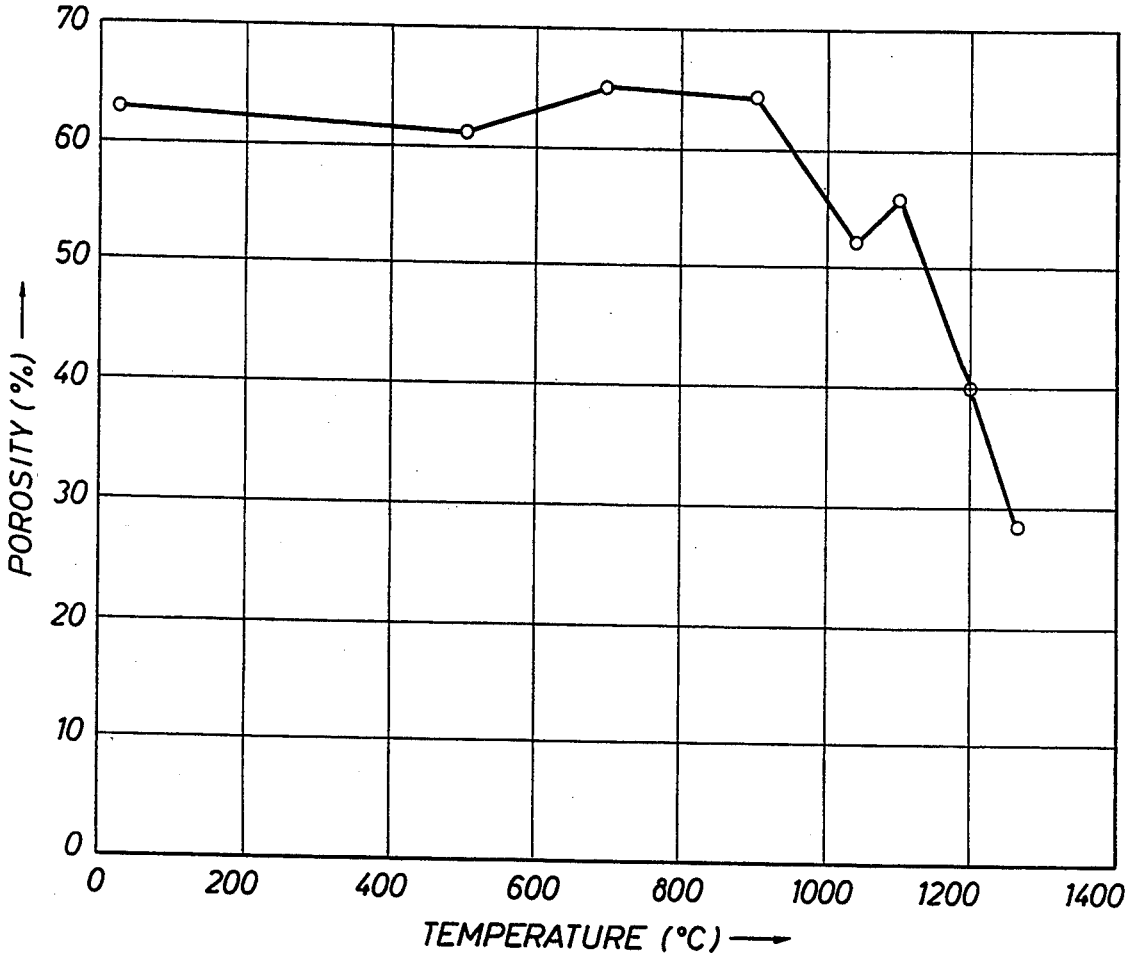
FIG. 1 is a plot of the porosity of diatomite as it is exposed to elevated temperatures at atmospheric pressure.

FIG. 1 is a plot of the porosity of a diatomite rock after the rock has been heated to varying temperatures while exposed to atmospheric pressure. The bulk density of the diatomite increases inversely with the decrease in porosity of the diatomite. Thermal conductivity at about 1400° F. (760° C.) is about $4\times10^{-3}$ cal/cm-/sec/°C. after the diatomite has been heated to above 2282° F. (1250° C.), whereas the thermal conductivity of the initial diatomite at 1400° F. (760° C.) is about $0.6\times10^{-3}$ cal/cm/sec/C. Sintering the diatomite a large distance from the heater therefore significantly increases the amount of heat that can be injected into the formation from the heater with the same heater temperature level.

Figure 3:
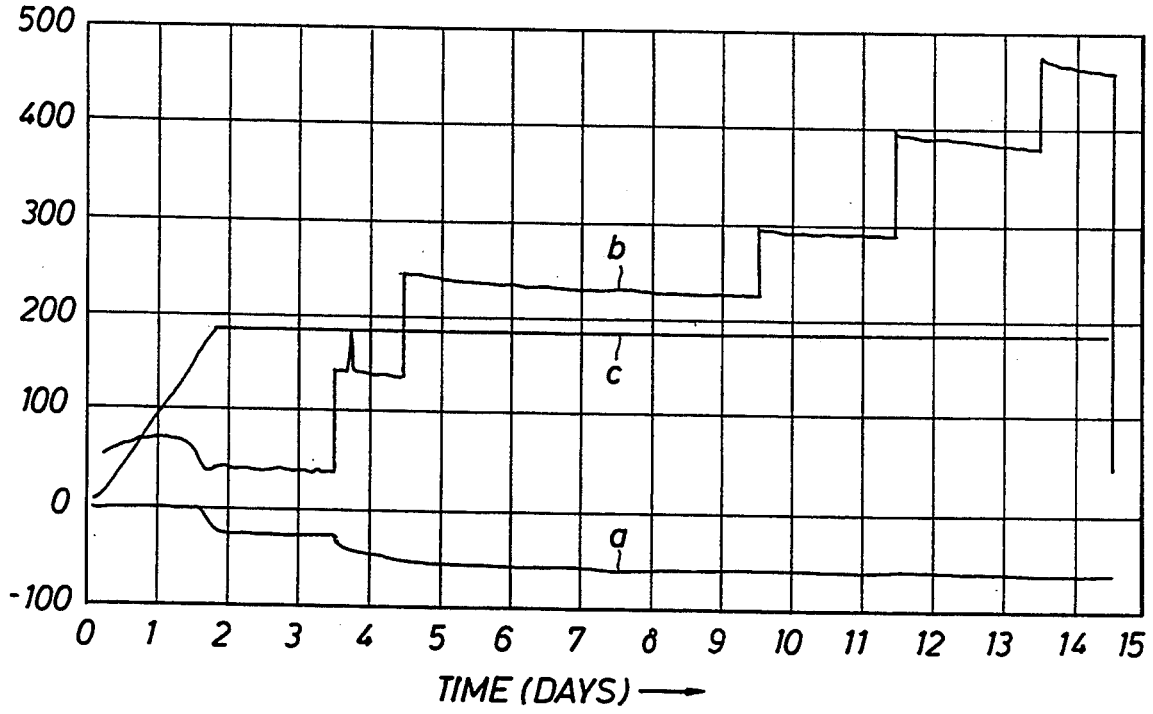
FIG. 3 is a plot of temperature, pressure and volume of a diatomite block as a function of time.

The effect of elevated temperatures and pressures on a diatomite rock was demonstrated by elevating the temperature of a confined sample of diatomite from room temperature to 1900° F. (1038° C.) over about a 36-hour period, and increasing pressure on the heated diatomite. The volume of the diatomite was recorded as the temperature and pressure were increased. FIG. 3 is a plot of pressure (line b, in psia), temperature (line c, in ° F./10), and volume (line a, in change in volume divided by initial volume as percent) as functions of time for this test. From FIG. 3 it can be seen that heating the diatomite to 1900° F. (1038° C.) caused the volume of the rock to decrease by about 25% at a pressure of about 40 psia. Increasing the pressure on the rock to about 235 psia caused a rapid decrease in volume to about 50% of the original volume. Further increases in pressure resulted in only very small changes in volume because little porosity remained. After the application of heat and pressure, the diatomite was no longer a high porosity, soft, white rock but was dense, hard, dark-colored rock.

In an oil-bearing diatomite, oil components near the wellbore will coke when exposed to elevated temperatures. This coke will result in actual near-wellbore diatomites having improved thermal conductivity, increased strength, and decreased porosity compared to the diatomites of FIG. 3.

Figure 2:
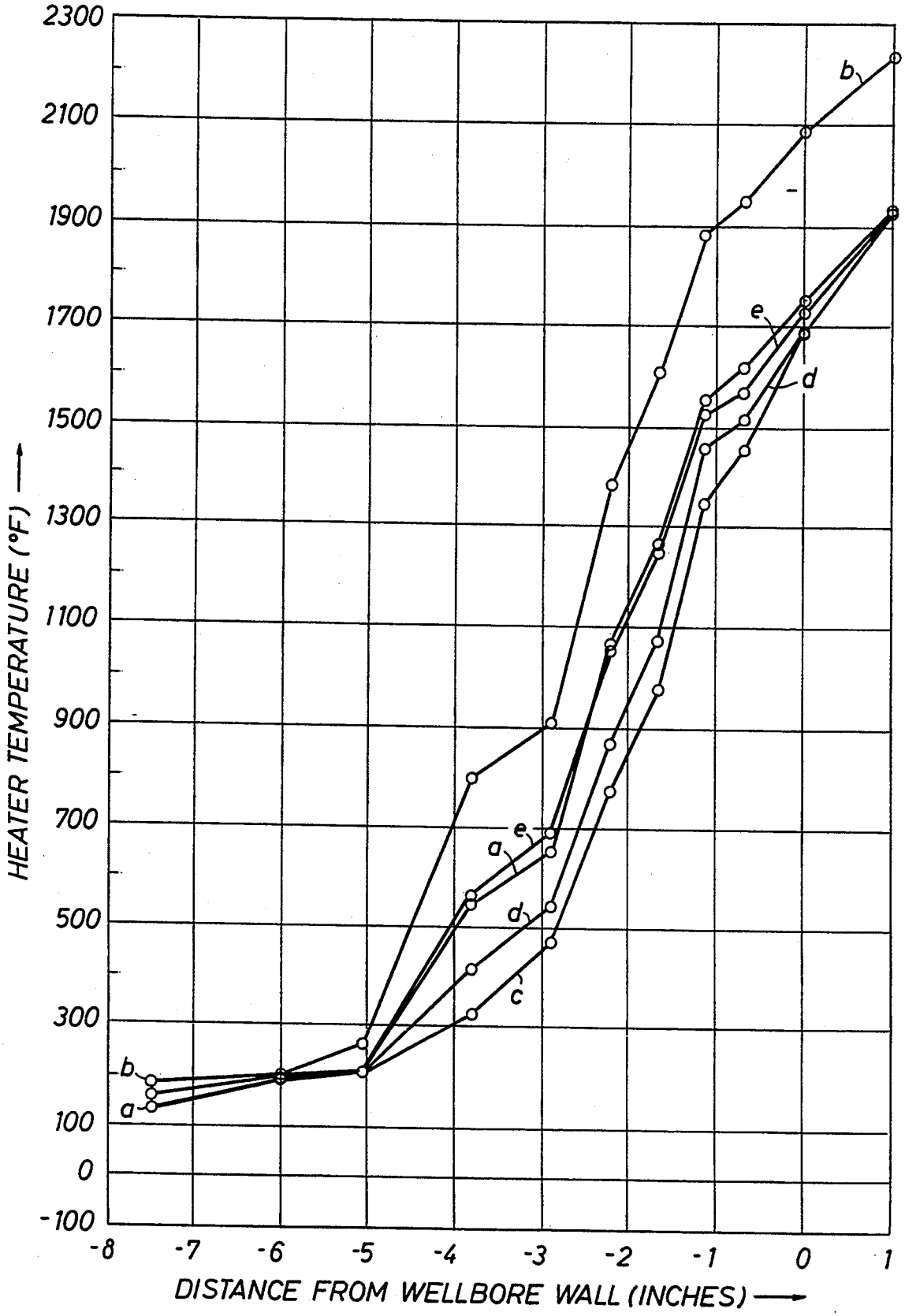
FIG. 2 is a plot of temperature vs. distance from a wellbore center in a diatomite block at different times as the block is exposed to elevated stress and temperature.

Referring now to FIG. 2, plots of temperature vs. distance from the center of a wellbore are shown as they were measured at different times. These temperature profiles illustrate the effect of the greater heat transfer coefficients resulting from sintering the diatomite at greater temperature levels for limited time periods. The temperature profiles were obtained using a cube of diatomite having eighteen inch sides with a three and one half inch vertical borehole drilled fourteen inches deep from the center of the top side. Thermocouples were placed within the cube at various distances from the centerline of the borehole. A fourteen inch long and three and one half inch outside diameter casing of "HAYNES A230" alloy was placed in the borehole, and a ten inch long, one and three quarter inch diameter heater coil was placed in the casing.

The diatomite cube was placed in a "triaxial cell" wherein stresses could be imposed on the cube from three directions. Stresses in the vertical and one lateral direction were maintained at about three hundred psig, and stresses in the other lateral direction were maintained at about five hundred psig.

Figure 5:
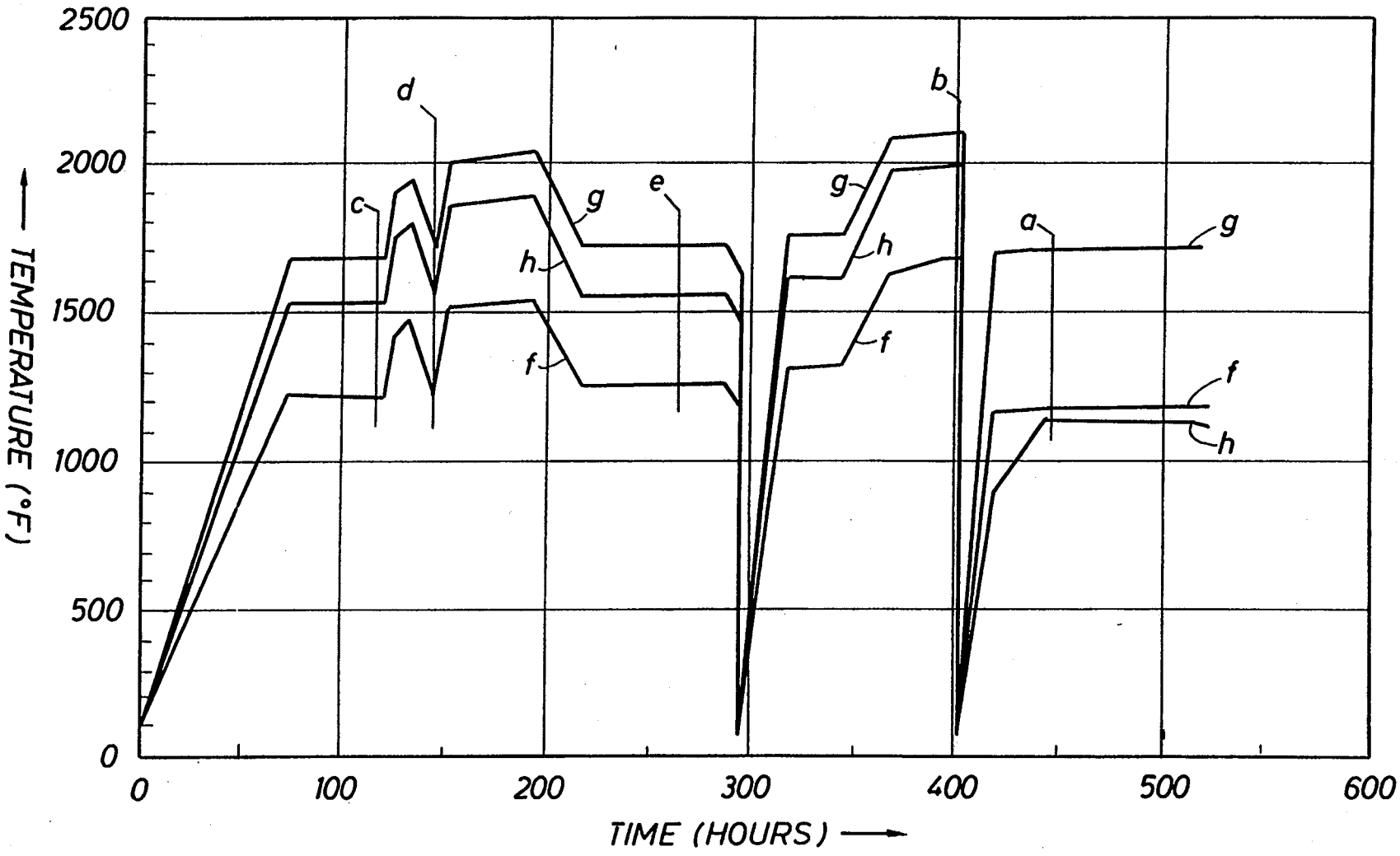
FIG. 5 is a plot of temperature vs time for three thermocouples embedded along a casing within the block of diatomite of FIG. 2 as the block of diatomite is exposed to heat and stress.

FIG. 5 is a plot of temperature vs. time for three thermocouples placed along the outside of the casing. This plot shows the temperature-time history of the block of diatomite as the temperature profiles of FIG. 2 were recorded. Lines f, g, and h, on FIG. 5 represent temperatures of thermocouples located across from the top, middle, and bottom, respectively, of the heater coil. As would be expected, the temperature at the middle of the heater coil is the highest, and the temperature at the top of the coil is the lowest. Vertical lines a through e in FIG. 5 represent the times at which the temperature profiles of FIG. 2 lines a through e, respectively, were recorded.

It can be seen from the temperature profiles of FIG. 2, that the steady state temperature profiles are higher after each time the block was exposed for a short time period to a higher temperature, as shown on the temperature history of FIG. 5. These higher temperature profiles represent a significantly greater ability to transfer heat into the formations with limited long-term heater temperatures.

The process of the present invention can be applied in a preferred mode by utilizing a gas fired heater, and operating the heater at an elevated internal pressure during the sintering step. The higher internal pressure can result in greater combustion air and fuel gas compression costs, but will reduce the stresses imposed upon the casing, and thereby permit greater short-term temperature for the sintering operation.

Upon initial firing of the preferred gas fired heater of the present invention, the heater is preferably first brought to a temperature of about 1600° F. (871° C.). At this temperature the time to creep failure is 100,000 hours or greater for many high temperature alloys at a stress of 1000 psi. The heater is maintained at about that temperature until nearly steady-state temperatures are achieved in the immediate vicinity of the borehole. This can be, for example, about one to six months. The heater temperature is then raised to about 1900° F. (1038° C.) or greater and allowed to stay at that level for a sintering period of about one to thirty days. This temperature is a temperature above that which the heater could be operated at for an extended time period, but below that which would cause a failure of the heater in the sintering period. This sintering period will propagate a heat front away from the well resulting in further sintering of the diatomite about 3 to 6 inches radially away from the wellbore. The sintering period is preferably long enough to propagate the zone of a temperature above about 1700° F. (927° C.) out a significant distance from the wellbore. The temperature is then reduced to less than about 1800° F. (982° C.), or preferably about 1700° F. (927° C.), for an extended time period. The extended time period is preferably for the duration of the thermal conduction process. This can be, for example, about ten years.

Although the sintering will occur to radial distances of only about 6 inches, porosity reduction can occur to as far as five feet from the wellbore due to thermal compaction of the diatomite.

During the sintering step, or the period during which the heater is operated at the elevated temperature, the temperature of the heater material is kept below the point where elastic collapse of the wellbore occurs. The pressure, or differential pressure between the inside of the casing and the pressures imposed by formation stresses, at which elastic collapse of the heater casing occurs can be estimated by the equation:

$$\text{Collapse Pressure} = E\,h^3/(4(1-u^2)R^3)$$

where E is the Young's modulus of the heater casing at temperature, u is Poisson's ratio at temperature, R is the radius of the pipe, and h is the wall thickness of the pipe. The heater casing temperature must be kept at a temperature below that which would result in the formation stress exceeding the collapse pressure. Operation at 1900° F. (1038° C.) longer than about one to thirty days is not preferred because creep collapse of the casing may occur with most preferred high temperature alloy heater casings.

When the heater temperature is reduced to about 1600° F. (871° C.), the diatomite in the near wellbore region has sintered to a low porosity and converted to a high Opal-CT content. This sheath of sintered diatomite has a substantially higher thermal conductivity and a substantially greater mechanical strength and creep resistance than the original diatomite. This solid sheath gives extra strength to the wellbore and prevents long term creep collapse of the casing at temperatures of about 1700° F. (927° C.). The heater can operate at somewhat lower temperatures long-term and still achieve a high heat injectivity due to the high conductivity sheath of sintered diatomite as well as the compacted zone extended out several feet into the diatomite.

Diatomite, being a soft and malleable rock, will fill voids when a wellbore is drilled through a formation which is exposed to lateral stresses. Typically, after a well is drilled, a casing is placed and cemented in the formation without much delay or the formation will close and the casing will not fit in the borehole. In the preferred method of the present invention, a wellbore is drilled using well known techniques, and then a heater is placed within the wellbore. Given time, the formation will close tightly around the heater. In a typical Belridge diatomite formation having about 60% porosity, a 10-inch diameter borehole will close to less than 8 inches in several days. Formations with stronger diatomites or less lateral stresses may require a somewhat longer time to close tightly around the heater. The amount of time required for a particular formation may be estimated by calipering a wellbore at time intervals after drilling using known methods of caliper logging of wellbores.

When a heater of the present invention is cemented into a formation rather than allowing the diatomite formations to close around the heater without cements, it is preferred that a hole of a minimal diameter be drilled to minimize the thickness of the cement annulus around the heater.

When the heater of the present invention is placed in the diatomite formation without cement, the rate at which the formation closes around the heater may be maximized by reducing the static head within the wellbore during the period during which the formation is closing around the heater. This can be accomplished by reducing the height of drilling fluid in the wellbore, or reducing the density of the fluid. Alternatively, replacement of drilling fluid with a fluid that does not contain fluid loss additives and does not have properties that inhibit fluid loss will cause the wellbore pressure to equalize with the formation pore pressure and thereby be to minimal.

The heater of the present invention could be an electrically-fired heater such as the heater disclosed in U.S. Pat. No. 5,065,818, incorporated herein by reference. These heaters can be installed from a coiled roll and are only about 1-inch in diameter. The wellbore can, therefore, be of a relatively small diameter. The relatively small diameter wellbore significantly reduces drilling costs.

A preferred gas-fired heater suitable for the practice of the present invention is disclosed in U.S. Pat. No. 5,255,742, incorporated herein by reference. This heater utilizes flameless combustion and a carbon formation suppressant. This heater configuration eliminates flames by preheating fuel gas and combustion air to above the autoignition temperature and then combining increments of fuel gas with the combustion air such that a flame does not occur at the point of mixing.

The method of the present invention is preferably utilized as a part of a method to recover oil from the diatomite according to a process such as that disclosed in patent application Ser. No. 896,864, filed Jun. 12, 1992, now U.S. Pat. No. 5,297,626 incorporated herein by reference. In this process, liquid hydrocarbons are driven from the diatomite formation in the vicinity of the heat injection well to a production wellbore. The production wellbore is preferably a fractured wellbore, and the heat injection wells are arranged in a staggered pattern on each side of the fracture.

Figure 4:
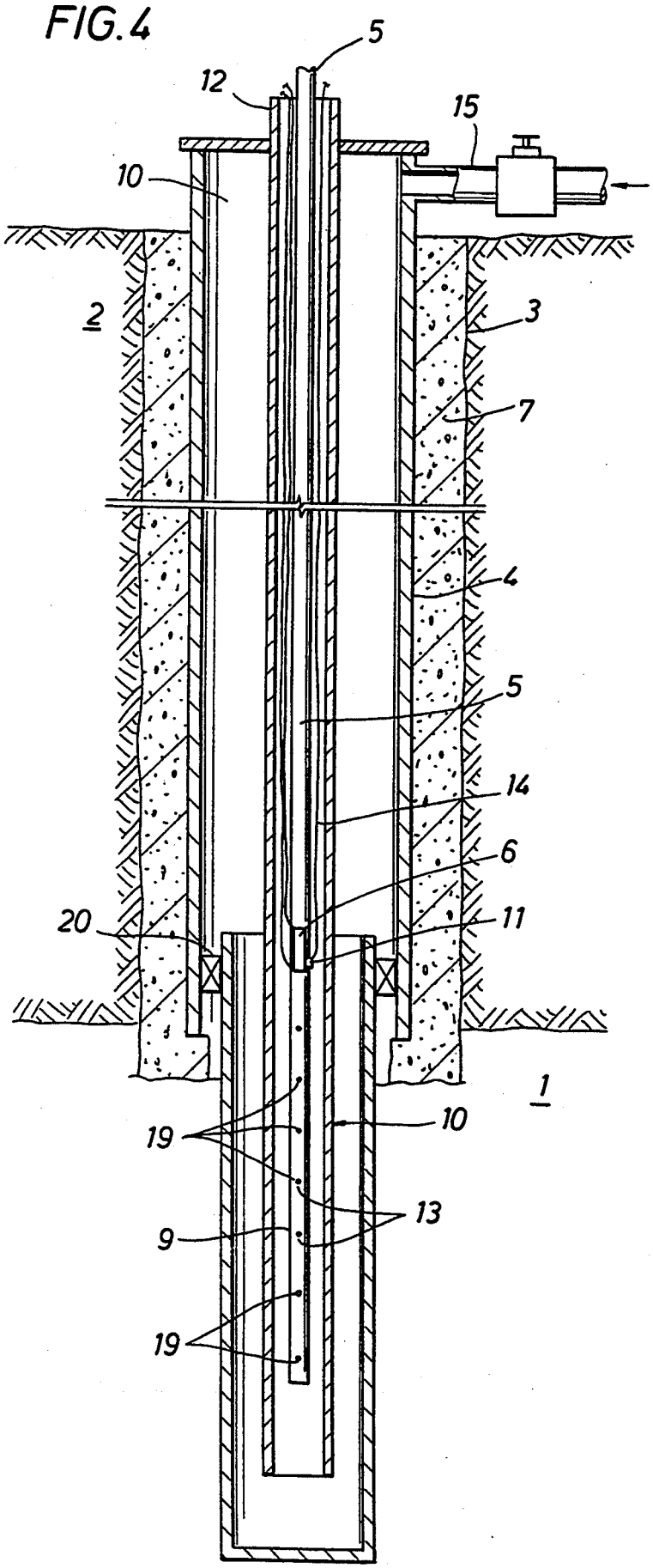
FIG. 4 is a preferred heater according to the present invention.

Referring now to FIG. 4, a preferred configuration for a burner of the present invention is shown. FIG. 4 shows a burner having a concentric configuration.

Combustion air travels down a combustion air conduit, 10, and mixes with fuel gas at mixing points, 19. A combustion gas return conduit, 12, is provided within the combustion air conduit. In the portion of the burner above the last mixing zone, and above the diatomite formation to be heated, the combustion air conduit may be cemented into the formation. Within the formation to be heated, the combustion air conduit is initially suspended into the formation to be heated. The formation will close tightly around the combustion air conduit after it is initially hung in place. A packer, 20, will provide a seal between the formation and the combustion air conduit contents. The configuration of FIG. 4 is preferred because of its simplicity and because of good heat transfer that would occur between hot combustion gases rising in the combustion gas return conduit and cold combustion air coming down the combustion air conduit.

Preferably, a plurality of fuel gas nozzles are provided to distribute the heat release within the formation to be heated. The orifices are sized to accomplish a nearly even temperature distribution within the casing. A nearly even temperature profile within the heater results in more uniform heat distribution within the formation to be heated. A nearly uniform heat distribution within the formation will result in more efficient utilization of heat in a conductive heating hydrocarbon recovery process. A more even temperature profile will also result in the lower maximum temperatures for the same heat release. Because the materials of construction of the heater and well system dictate the maximum temperatures, even temperature profiles will increase the heat release possible for the same materials of construction.

The number of orifices is limited only by the size of orifices which are to be used. If more orifices are used, they must generally be of a smaller size. Smaller orifices will plug more easily than larger orifices. The number of orifices is a trade-off between evenness of the temperature profile and the possibility of plugging.

The preheating of the fuel gases to obtain flameless combustion would result in significant generation of carbon within the fuel gas conduit unless a carbon formation suppressant is included in the fuel gas stream. The carbon formation suppressant may be carbon dioxide, steam, hydrogen or mixtures thereof. Carbon dioxide and steam are preferred due to the generally higher cost of hydrogen. Carbon dioxide is most preferred because steam can condense during start-up periods and shut-down periods and wash scale from the walls of the conduits, resulting in plugged orifices. Moreover, only steam raised from highly deionized water should be used as such a carbon formation suppressant.

Heat injectors utilizing flameless combustion of fuel gas at temperature levels of about 1650° F. (900° C.) to about 2000° F. (1093° C.) may be fabricated from high temperature alloys such as, for example, "HAYNES HR-120", "INCONEL 601GC", "INCONEL 617", "VDM 602CA", "INCOLOY 800HT", "HAYNES A230", "INCOLOYMA956". Preferred high temperature alloys include those, such as "HAYNES HR-120", having long creep rupture times. At temperatures higher than 2000° F. (1093° C.), ceramic materials are preferred. Ceramic materials with acceptable strength at temperatures of 900° C. to about 1400° C. are generally high alumina content ceramics. Other ceramics that may be useful include chrome oxide, zirconia oxide, and magnesium oxide-based ceramics. National Refractories and Minerals, Inc., Livermore, Calif., A. P. Green Industries, Inc., Mexico, Mo., and Alcoa, Alcoa Center, Pa., provide such materials.

The preceding description of the present invention is exemplary and reference is to be made to the following claims to determine the scope of the present invention.

We claim:

1. A method for heating a subterranean diatomite formation, the method comprising the steps of:

(a) drilling a wellbore into the diatomite formation;

(b) inserting a heater into the wellbore;

(c) initially operating at a long term operating temperature for a time period of greater than about six months, which long term operating temperature is at or below a temperature at which the heater would be expected to operate for a period of about ten years or longer;

(d) raising the heater temperature to a temperature that is at least 100° F. greater than the long term operating temperature for between about one day and about thirty days thereby sintering the diatomite formation in the vicinity of the heater; and (e) operating the heater for an extended period of time at or below the long term operating temperature.

2. The method of claim 1 wherein the heater is a gas-fired flameless combustion heater.

3. The method of claim 1 further comprising the step of driving liquid hydrocarbons from the diatomite formation in the vicinity of the wellbore by injection of heat from the heater.

4. The method of claim 3 further comprising the step of providing a production wellbore and wherein the hydrocarbons driven from the formation in the vicinity of the wellbore are recovered from a production wellbore.

5. The method of claim 4 wherein the production wellbore is a fractured wellbore.

6. The method of claim 5 wherein a plurality of heat injection wells are provided in a staggered pattern on each side of the fractures of the production well.

7. The method of claim 2 wherein, during step (d), the pressure within the heater is elevated and thereby increasing the temperature at which the heater may be operated without the pressure differential between the inside of the heater and the stress imposed by the formation exceeding the collapse pressure of the heater.

8. The method of claim 1 wherein the temperature at which the heater is initially operated at is about 1600° F.

9. The method of claim 8 wherein the long term operating temperature is about 1800° F.

10. The method of claim 9 further comprising the step of driving liquid hydrocarbons from the diatomite formation in the vicinity of the wellbore by injection of heat from the heater.

11. The method of claim 10 further comprising the step of providing a production wellbore and wherein the hydrocarbons driven from the formation in the vicinity of the wellbore are recovered from a production wellbore.

12. The method of claim 11 wherein the production wellbore is a fractured wellbore.

13. The method of claim 12 wherein a plurality of heat injection wells are provided in a staggered pattern on each side of the fractures of the production well.

* * * * *